United States Patent [19]

Wakabayashi

[11] 4,148,261

[45] Apr. 10, 1979

[54] TRANSFER SYSTEM FOR POWER-AND-FREE CONVEYOR

[75] Inventor: Takao Wakabayashi, Toyonaka, Japan

[73] Assignee: Standard Alliance Industries, Inc., Chicago, Ill.

[21] Appl. No.: 830,025

[22] Filed: Sep. 2, 1977

[51] Int. Cl.[2] ..... B61B 10/02

[52] U.S. Cl. ..... 104/172 S; 104/91; 104/96; 104/103

[58] Field of Search ..... 104/172 S, 89, 91, 94, 104/95, 96, 102, 103, 250

[56] References Cited

U.S. PATENT DOCUMENTS

| | | | |
|---|---|---|---|
| 3,229,645 | 1/1966 | Dehne | 104/172 S |
| 3,314,377 | 4/1967 | Dehne | 104/96 |
| 3,415,201 | 12/1968 | Czarnecki | 104/172 S X |
| 3,559,585 | 2/1971 | Lempio | 104/172 S |
| 3,623,538 | 11/1971 | Wakabayashi | 104/172 S |
| 3,662,873 | 5/1972 | Ross | 104/172 S X |
| 3,667,399 | 6/1972 | Czarnecki | 104/172 S |
| 3,744,432 | 7/1973 | Price et al. | 104/172 S |
| 3,800,709 | 4/1974 | DeGood et al. | 104/172 S |
| 4,073,237 | 2/1978 | Wakabayashi | 104/172 S X |

*Primary Examiner*—Albert J. Makay
*Assistant Examiner*—Randolph A. Reese
*Attorney, Agent, or Firm*—Harness, Dickey & Pierce

[57] ABSTRACT

In a power-and-free conveyor including a first free rail, a second free rail branching off from the first free rail, a first and a second power rail provided above the free rails respectively, a transfer system for transferring the carriers movably supported by the first free rail to the second free rail. An auxiliary rail attached to the first of the free rails slightly projects above the first free rail and has a cutaway section of requred length to the rear of the branching point of the second free rail. The carrier has at its front portion a pair of tilting drive and back-up dogs engageable with the propelling member driven along the power rail and at its rear portion a propelling member raising cam member. When a carrier advances into the cutaway section, a raising plate disposed near the front end of the rail cut-away portion, disengages the propelling member from the tilting drive dog on the carrier. A following propelling member advancing behind the disengaged propelling member engages under the cam member on the carrier in the cutaway section to push the carrier from behind and to advance the carrier to the second free rail. When the rear portion of the carrier approaches the branching point, the pushing propelling member ascends an upwardly slanting disengaging edge of the auxiliary rail at the front end of the cutaway section and is thereby disengaged from the carrier.

13 Claims, 12 Drawing Figures

TRANSFER SYSTEM FOR POWER-AND-FREE CONVEYOR

BACKGROUND OF THE INVENTION

This invention relates to a transfer system for a power-and-free conveyor.

Throughout the specification and the appended claims, the terms "front" or "forward" and "rear" or "rearward" are based on the direction of travel of the conveyor. Thus, the former refers to the direction in which the conveyor advances and the latter to the opposite direction.

With power-and-free conveyors, the drive force of power trolleys is transmitted to free trolleys through pushers. These conveyors have a distinct feature that free trolleys can be transferred as desired from a first free rail, serving as the main track, to a second free rail branching off from the first free rail. Such conveyors are useful and essential to the automation of quantity flow production. For example, several kinds of products from different processes may be transported on a conveyor and then fed to specified work lines on automatic selection. Articles which require a special operation such as readjustment may be transferred onto a branch line so that the articles can be worked on independently of the flow on the main line. The conveyor system may include an accumulation line for the adjustment of the rate or frequency of operation or a number of elongated branch lines serving as a storage for storing articles as sorted out.

At the branching portion of conveyor systems, the carrier disengaged from a pusher on the drive chain of the first power rail must be engaged by a pusher on the drive chain of the second power rail after traveling along the branch rail. At the section between the position where the carrier is disengaged from one pusher and the position where it is engaged by the other pusher, the carrier needs to be propelled by some auxiliary means. For this purpose, the carrier is usually provided on its rear free trolley with an auxiliary dog adapted to be engaged by a pusher on the power rail which is positioned at a reduced spacing from the free rail in the above-mentioned section so that the pusher pushes the carrier from behind. Alternatively, the rear free trolley is equipped with an engagement body which is engaged by another pusher on the drive chain for pushing the carrier from behind. Thus, the conventional systems require auxiliary pushing means which renders the system complex and costly.

SUMMARY OF THE INVENTION

This invention provides a transfer system by which carriers can be smoothly transferred from a free rail to another free rail without using any auxiliary propelling means for pushing the carriers from behind.

In a power-and-free conveyor including a first rail serving as a main track, a second free rail branching off from the first free rail, a first and a second power rail provided above the free rails respectively at a specified distance therefrom, carriers movably supported by the first free rail, and a plurality of propelling members supported by the power rails as spaced apart by a specified distance and movable along the power rails, the carriers being travelable along the first free rail and transferable from the first free rail to the second free rail by being propelled by the propelling members, this invention provides a transfer system comprising the carriers each having at its front portion main engaging means engageable with and disengageable from the propelling member and at its rear portion pushing engagement means, an auxiliary rail attached to at least the first of the free rails and slightly projecting above the first free rail to receive the bottom of the propelling members in sliding contact therewith, the auxiliary rail being attached to at least one side of the first free rail and having a cutaway section of required length to the rear of the branching point of the second free rail, a first disengaging means disposed near the front end of the cutaway section of the auxiliary rail for disengaging the propelling member from the main engaging means on a carrier advancing into the cutaway section a second disengaging means disposed near the rear end of the cutaway section of the auxiliary rail for disengaging the propelling member from the main engaging means on a following carrier, the pushing engagement means being formed at its rear end with a pushing engagement sloping face forwardly downwardly sloping from substantially the same level as the upper edge of the auxiliary rail and engageable by a propelling member advancing from behind within the cut-away section, the end of the auxiliary rail defining the front end of the cutaway section being formed with an upwardly slanting edge for disengaging the propelling member from the pushing engagement means.

As will become apparent from the embodiment to be described below, this invention is characterized in that a propelling member raising cam for successively stopping a series of carriers following a preceding carrier is also made serviceable as the pushing engagement means by the auxiliary rail provided for maintaining the propelling member in stable engagement with the main engaging means. For this purpose, the pushing engagement means is preferably formed at its rear end with a ridge positioned substantially at the same level as the upper edge of the auxiliary rail and defined by a sloping cam face for raising the propelling member and by the pushing engagement sloping face, the two faces sloping in different directions. Except where the free rail branches off, the propelling member raising cam face sloping upward from the level of the upper edge of the auxiliary rail serves to automatically successively halt carriers following a preceding carrier. In the auxiliary rail cutaway section, the propelling member comes into engagement with the pushing engagement sloping face of the preceding carrier which sloping face is positioned below the level of the auxiliary rail upper edge to push the carrier from behind and transfer the carrier to the branched rail. The propelling member is disengaged from the pushing engagement sloping face by the upwardly slanting edge of the auxiliary rail, whereby the carrier is relieved of the pushing force. Accordingly, the carrier can be smoothly transferred from the first free rail to the second free rail without using any auxiliary propelling means for pushing the carrier from behind.

This invention will be described below in greater detail with reference to the accompanying drawings.

DESCRIPTION OF THE PREFERRED EMBODIMENT

Figure 1:
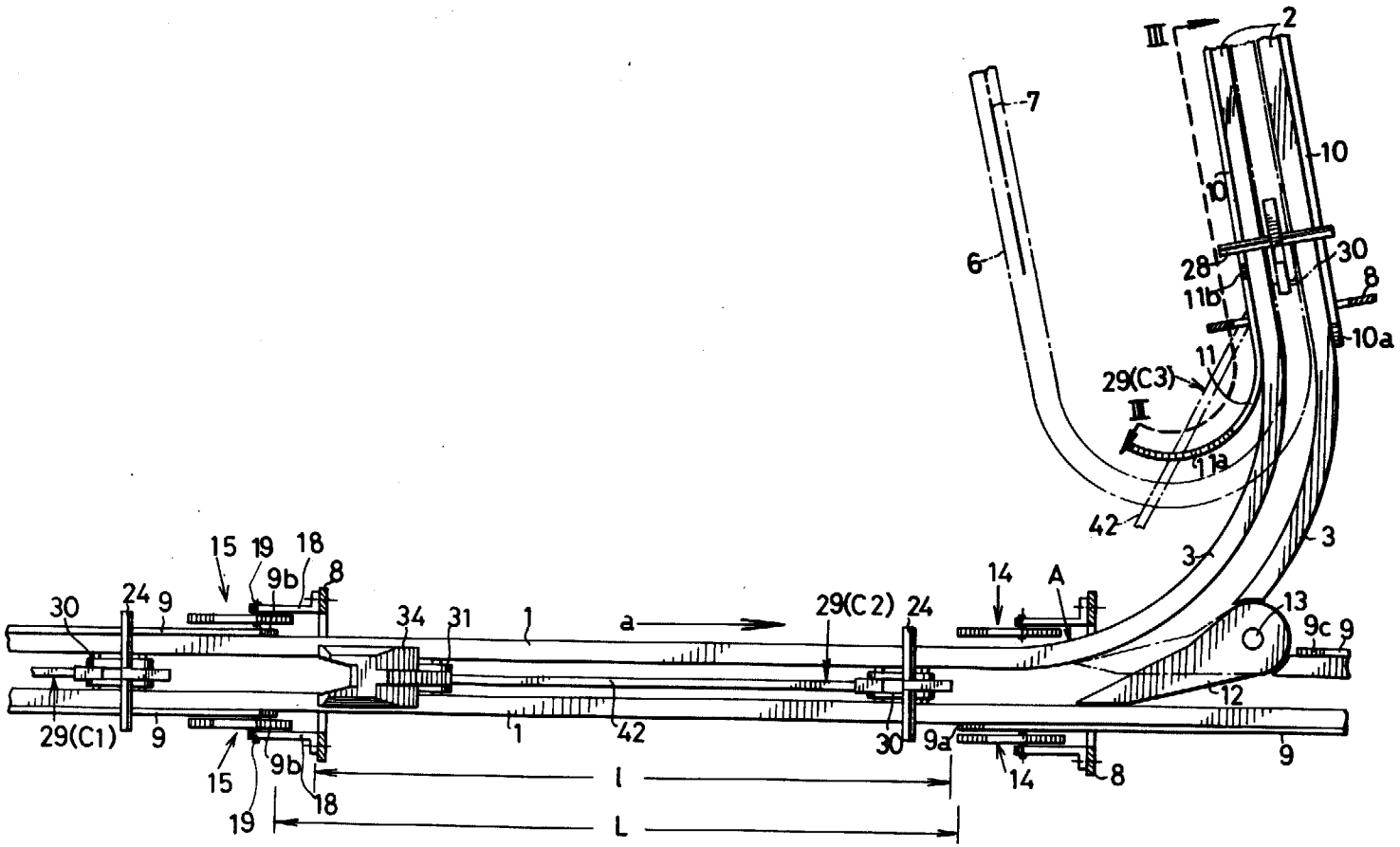
FIG. 1 is a plan view showing a transfer system embodying this invention.
Figure 2:
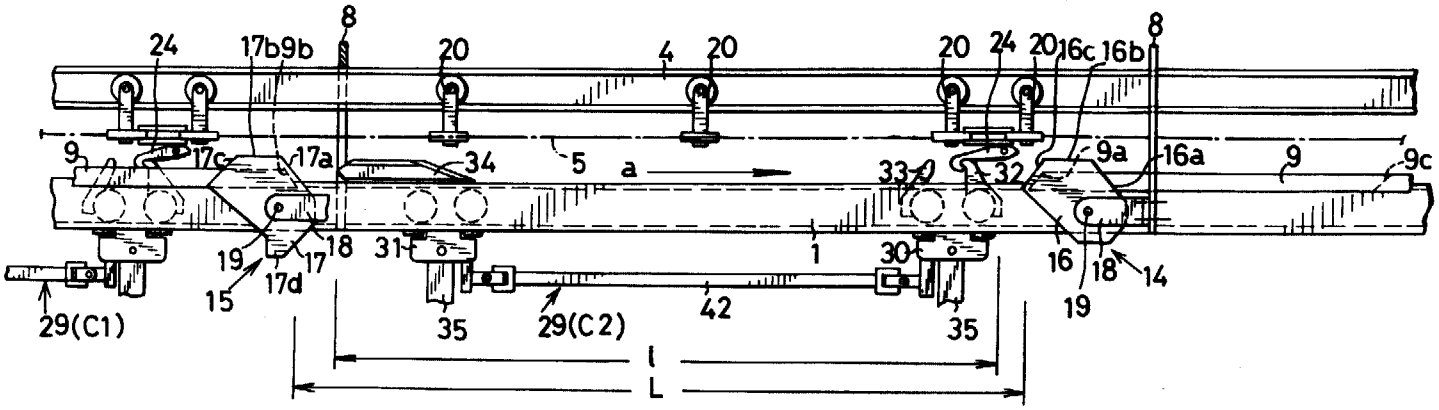
FIG. 2 is a side elevation showing the transfer system.
Figure 3:
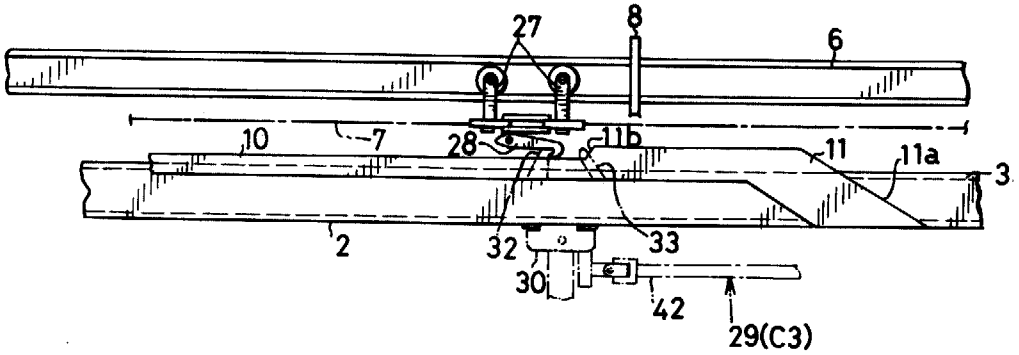
FIG. 3 is a side elevation in development along the line III—III in FIG. 1.
Figure 5:
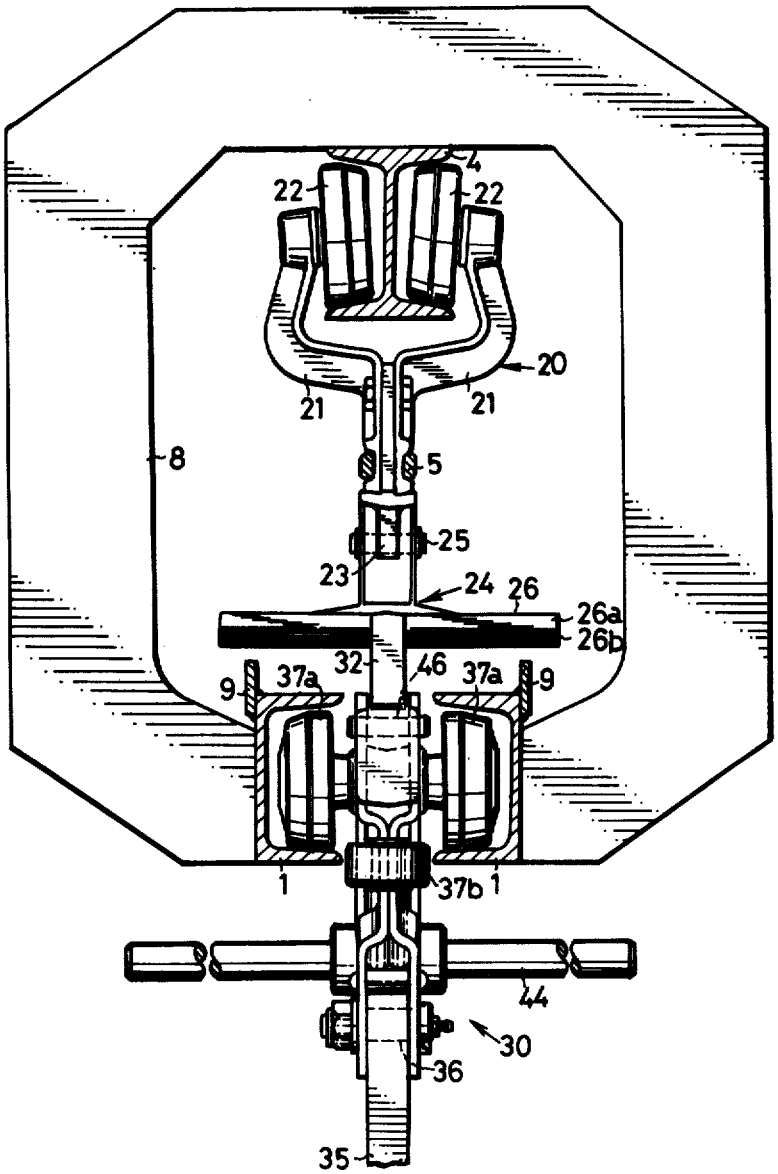
FIG. 5 is a view in section taken along the line V—V in FIG. 4.
Figure 7:
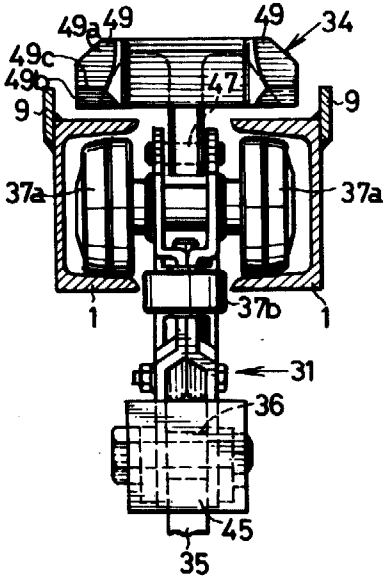
FIG. 7 is a view in section taken along the line VII—VII in FIG. 6.
Figure 6:
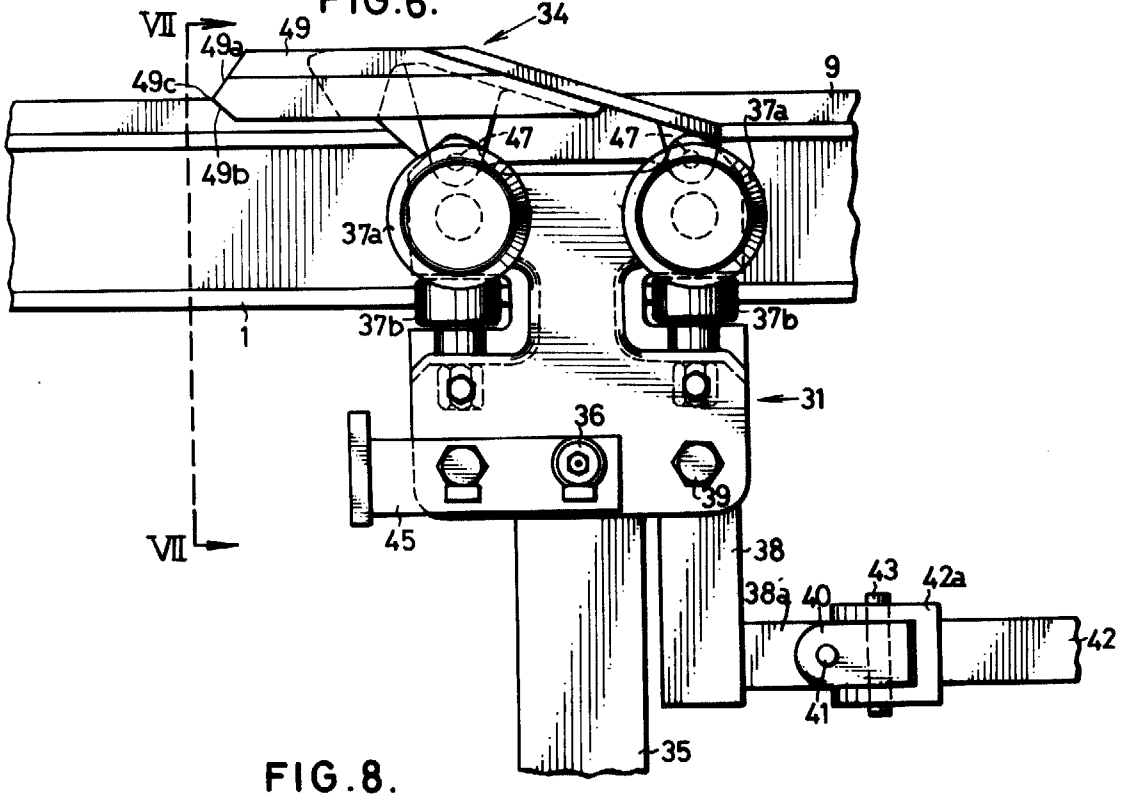
FIG. 6 is an enlarged side elevation showing a rear free trolley.
Figure 8:
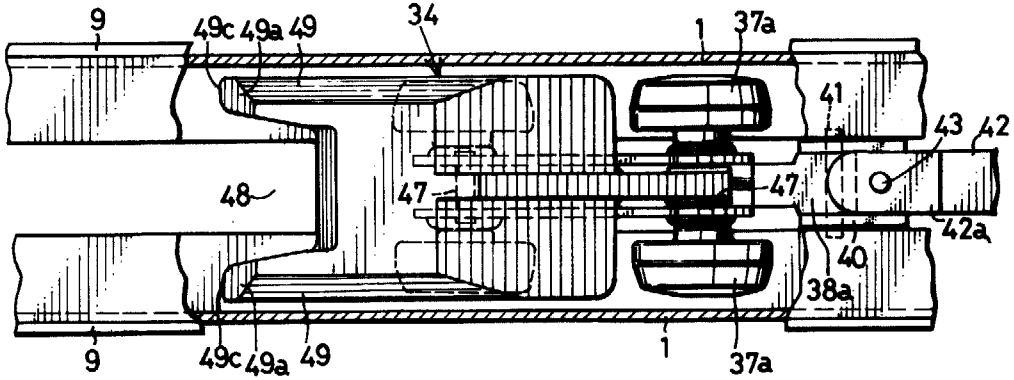
FIG. 8 is an enlarged plan view showing the rear free trolley.

With reference to FIGS. 1 to 3 showing an embodiment of this invention, a first free rail 1 providing a main track horizontally extends straight. A second free rail 2 branching off from the main free rail 1 is disposed approximately at a right angle thereto. The second free rail 2 is positioned horizontally at the same level as the rail 1. The branching point A of the first free rail 1 and one end of the second free rail 2 are interconnected by a curved branch free rail 3. A first power rail 4 provided above the first free rail 1 at a required spacing is endless although not shown because of its relationship with a propelling means including a drive endless chain 5 disposed below the rail 4. Similarly, a second power rail 6 is disposed above the second free rail 2 at a required spacing therefrom and is an endless line including a circular arc turn above the branch free rail 3. The first power rail 4 is connected to the first free rail 1 by frames 8 arranged at a specified spacing. Similarly, the second power rail 6 is connected to the second free rail 2. Each of the free rails 1, 2 and 3 comprises a pair of channel steel members spaced apart by a specified distance with their grooves facing each other as shown in FIG. 5. The power rails 4 and 6 each comprise a steel member of I-shaped cross section as shown in FIG. 5.

Auxiliary rails 9 are welded to the opposite sides of the first free rail 1 over the entire length thereof other than a specified section L positioned to the rear of the branching point a. The auxiliary rails 9 project slightly above the main rail, namely the first free rail 1 to slidingly receive the bottom of the horizontal portion 26 of the propelling member 24 which also is part of the propelling means and is described later. The section L where the auxiliary rails 9 are cut away must be longer than the length l of a carrier 29 slidable on the first free rail 1. Adjacent the section L where the auxiliary rails 9 are cut away, the auxiliary rails have an upwardly slanting disengaging edge 9*a* to the front of the section L and downwardly slanting edges 9*b* to the rear for smoothly lowering the propelling member 24. To provide a switching device 12, one of the auxiliary rails 9 is cut away over a greater length than the other and has an upwardly slanting edge 9*c* to the front of the switching device 12. Auxiliary rails 10 are also welded to the opposite sides of the second free rail 2 over the entire length thereof. One of the auxiliary rails 10 extends away from the second free rail 2 at the junction between the rail 2 and the branch free rail 3, along the curve of the second power rail 6 inside thereof. The extension of the rail 10 further projects upward, providing a collision preventing projection 11. One end of the projection 11 has an edge 11*a* upwardly slanting approximately from the level of the lower edge of the branch free rail 3. The other end of the projection 11 has an edge 11*b* sloping downward to the upper edge of the auxiliary rail 10. The other auxiliary rail 10 has an upwardly slanting edge 10*a* at its end. Although the auxiliary rails 9 and 10 are in the form of a strip disposed vertically, the auxiliary rails may have any cross section such as an inverted L-shaped cross section insofar as the propelling member 24 can be received by the auxiliary rails. The auxiliary rails 9 and 10 may be provided on only one side of the free rails 1 and 2, or the first free rail 1 alone may be provided with an auxiliary rail on its one side.

The switching device 12 is provided at the location where the free rail 3 branches off from the first free rail 1 for permitting carriers 29 to advance straight on the first free rail 1 or for causing them to deviate along the second free rail 2. The switching device 12 comprises a tapered plate disposed on the same plane as the lower horizontal flanges of the free rails 1 and 3 and supported by a pin 13 horizontally pivotably. The switching device 12, which may be of known structure, is movable by unillustrated drive means between a deviating position shown in the solid line in FIG. 1 and a straight position indicated in the broken line. On the opposite sides of the first free rail 1, first and second disengaging means 14 and 15 are arranged at the opposite ends of the section L respectively as spaced apart by a distance greater than the length l of the carrier 29. The disengaging means 14 and 15 comprise pairs of first and second raising plates 16 and 17 which are projectable above the path of travel of the horizontal portion 26 of the propelling member 24, namely above the upper edges of the auxiliary rails 9, and retractable therefrom. When in their projected position, the plates have their front and rear sloping portions positioned above the rail edges. Stated more specifically with reference to FIG. 9 in which the raising plate 16 is shown on an enlarged scale, the raising plates 16, 17 are polygonal and have upper sides 16*a*, 17*a* substantially flush with the horizontal upper edges of the auxiliary rails 9, first sloping sides 16*b*, 17*b* continuous with the upper sides 16*a*, 17*a* at an obtuse angle thereto and second sloping sides 16*c*, 17*c* continuous with the first sloping sides at an obtuse angle. Each of the plates is pivoted by a pin 19 to a bracket 18 secured to the lower end of the frame 8. The second raising plate 17 has at its lower portion a downwardly projecting stopping piece 17*d* which is projectable, during the disengagement to be described later, into the path of travel of a stop pin 44 outwardly extending from a front free trolley 30. The first raising plate 16 is not provided with a member corresponding to the projecting piece 17*d*. The raising plates 16 and 17 are turnable through a specified angle by unillustrated suitable drive means, for example by air cylinders through links connected to their pivot pins 19. The raising plates 16 and 17 need not always be provided each in a pair on the opposite sides of the first free rail 1 but a raising plate may be disposed on only one side of the rail 1.

Figure 4:
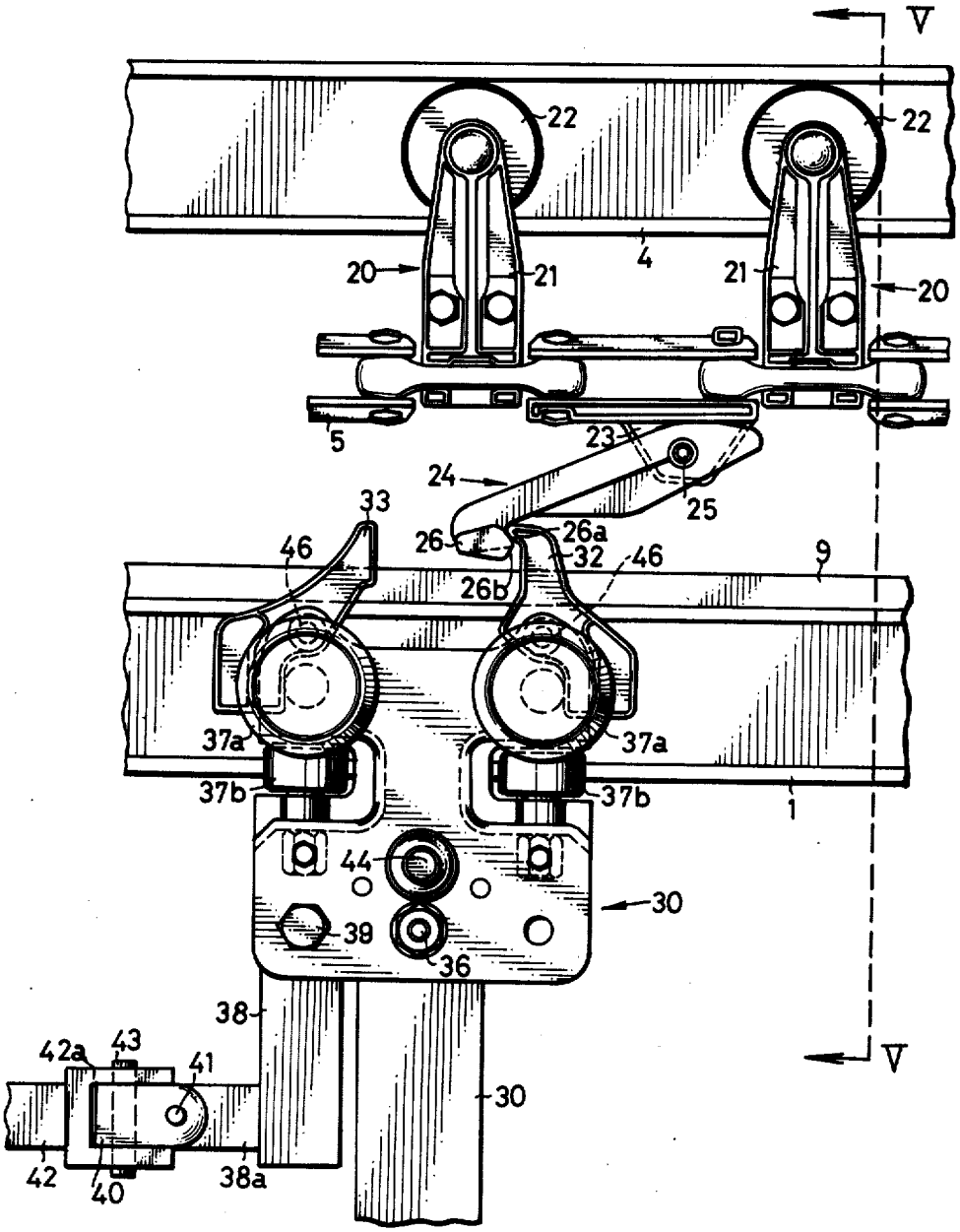
FIG. 4 is an enlarged side elevation showing power trolleys and a front free trolley.

With reference to FIGS. 4 and 5, a power trolley 20 includes a pair of arms 21 and a pair of rollers 22 mounted on the upper ends of the arms respectively and rollable on the upper surfaces of the lower horizontal flanges of the first power rail 4. The trolley 20 is therefore movable on the rail 4. The endless drive chain 5 disposed below the rail 4 is driven at all times in the direction of an arrow a shown in FIGS. 1 and 2 by an unillustrated motor and transmission means. The lower ends of the arms 21 of the trolley 20 are connected to the chain 5. The trolleys 20 are arranged in pairs at a regular spacing. The pair of the trolleys 20 are interconnected by link plates of the chain 5. A downwardly projecting bracket 23 is secured to the lower link plate. The propelling member 24 is pivoted by a pin 25 to the bracket 23 and suspended therefrom as projected rearwardly obliquely downward by gravity. The member 24 has a hook-shaped lower end provided with a horizontal portion 26 extending over the upper edges of the auxiliary rails 9 and longer than the spacing between the pair of raising plates 16 or 17. When seen in plan, the propelling member 24 is T-shaped. The horizontal portion 26 has a planar bottom surface slidable on the upper edges of the auxiliary rails 9. The horizontal portion 26 is formed on its front side with first and second slopes comprising a driving face **26*a* a cam face 26*b* slanting rearwardly upward and downward respectively. Between pairs of power trolleys carrying the propelling members 24, one to several power trolleys 20 are connected to the chain 5 as arranged at such a spacing as to prevent the chain 5 from slackening. Preferably, the members 24 are spaced apart by a distance greater than the length of the section L where the side rails 9 are cut away. The power rail 6 above the second free rail 2 is similarly provided with a drive chain 7 therebelow. The chain 7 has connected thereto power trolleys 27 movable on the power rail 6 and propelling members 28** at a specified spacing.

With reference to FIG. 2 and FIGS. 4 to 8, a carrier 29 travellable on the free rails 1 and 2 comprises a front primary free trolley 30 having a pair of front and rear tilting dogs 32 and 33 (main engaging means) and a rear secondary free trolley 31 having a propelling member raising cam 34 (pushing engagement means or cam driver) projecting rearward. Each of the trolleys 30 and 31 has a hanger 35 pivoted to its lower end by a pin 36 and is provided with a front and a rear pair of vertical rollers **37*a* rollable on the upper surfaces of the lower flanges of the free rail 1 and with horizontal rollers 37*b* rollable on the opposed inner edges of the flanges. The free trolleys 30 and 31 further have downwardly projecting pieces 38 attached thereto by pins 39. Short projections 38*a* horizontally extending from the projecting pieces 38 toward each other carry bifurcated joints 40 vertically pivotally mounted on the projections 38*a* by pins 41. A link 42 has at its opposite ends laterally U-shaped portions 42*a* which are horizontally pivotally connected to the joints 40 by pins 43. Thus, the free trolleys 30 and 31 are connected together by the link 42. The front primary trolley 30 has a stop pin 44 extending horizontally sidewise from its opposite sides. The rear secondary free trolley 31 has a bumper 45** extending horizontally rearward for the following carrier.

The front and rear tilting dogs 32 and 33 are positioned in the center of the free rail 1 and pivoted to the trolley 30 by pins 46 so as to be tiltable inward toward each other and raisable by gravity. The dogs are prevented from tilting outward by the contact of their lower ends with the shafts of the rollers **37*a*. The top end of the front tilting dog 32 projects rearward in the form of a bill for engagement with the horizontal portion 26 of the propelling member 24. The cam 34 has a width smaller than the distance between the auxiliary rails 9 and is mounted on the trolley 31 by pins 47. When seen in side elevation, the front half of the cam 34 is sloped, while the rear half thereof projects rearward from the trolley 31. The projecting rear portion is centrally cut out in a U-shape as at 48, the cutout 48 slightly flaring rearward. The rearward projection 49 on each of the opposite sides defining the cutout 48 is formed at its extremity with a sloping cam face 49*a* for raising the propelling member and with a pushing engagement sloping face 49*b*. The sloping cam face 49*a* slopes rearwardly downward from the top of the projection 49. The sloping face 49*b* slopes forwardly downward from the extremity of the cam face 49*a*. The ridge 49*c* where the two sloping faces 49*a* and 49*b* meet is substantially at the same level as the upper edge of the auxiliary rails 9**.

Alternatively, the cam 34 may be mounted on the trolley 31 horizontally pivotably. Furthermore, an intermediate trolley may be provided between, and connected by links to, the front and rear trolleys 30 and 31, with a hanger 35 attached to the intermediate trolley. The slanting edges **9*a*, 9*b*, sloping sides 16*b*, 16*c* and sloping faces 49*a*, 49*b*** which are shown as straight or planar can be somewhat curved.

As shown in FIG. 2, the carrier 29 is driven together with the drive chain 5 in the direction of the arrow a by the engagement of the propelling member 24 with the front tilting driving dog 32 on its front primary free trolley 30. Similarly, a large number of carriers 29 follow the abovementioned carrier 29 as spaced apart by a specified distance. This distance is dependent on the spacing between the members 24 suspended from the drive chain 5.

Figure 9:
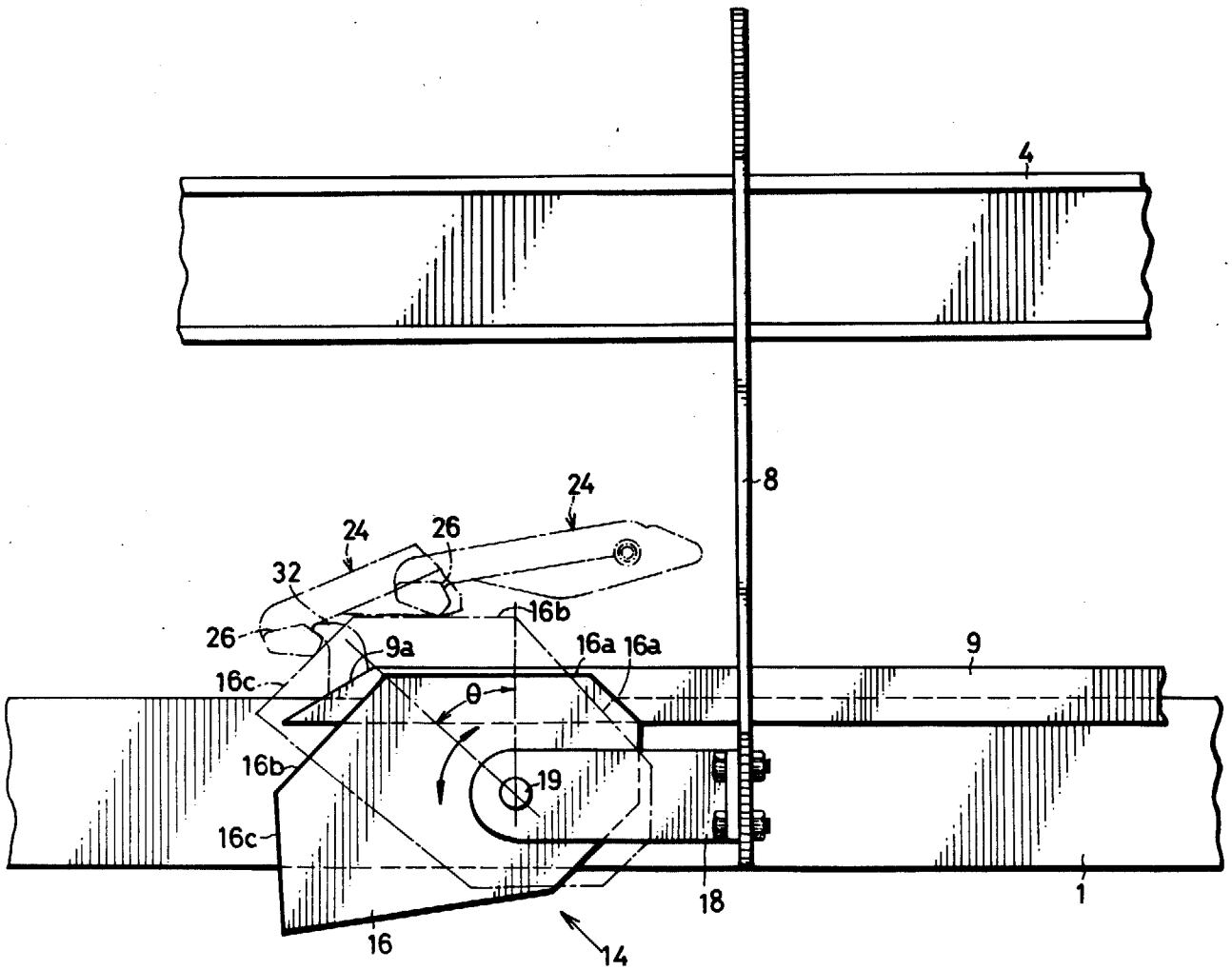
FIG. 9 is an enlarged side elevation showing disengaging means and its function.

When the first of the carriers 29 traveling in series arrives at a position (indicated at $C_1$ in FIG. 2) immediately adjacent the second raising plates 17, the second raising plates 17 are in their non-operative position with their horizontal upper sides **17*a* positioned substantially flush with the upper edges of the auxiliary rails 9. The first carrier 29 passes between the second raising plates 17 and advances as indicated at $C_2$ into a section L comprising a transfer station where the rails 9 are cut away. By the term "first carrier" refers to one of a number of carriers in travel which is to be transferred to the second free rail 2 first. When the front trolley 30 of the first carrier 29 has passed between the second raising plates 17 and enters the transfer station L, the first and second raising plates 16 and 17 both turn clockwise through an angle $\theta$ as seen in FIG. 9, with the result that in the case of the first raising plates 16, the first sloping sides 16*b* rise to a horizontal position above the auxiliary rails 9 which position is at least at a higher level than the tilting dogs 32 and 33. In this position, the first sloping sides 16*b* above the rails 9 are continuous with the upper sides 16*a*, now in slanting state, to the front and with the second sloping sides 16*c* to the rear. When the front free trolley 30 of the advancing first carrier 29 has progressed to the exit end of the transfer station L and has traveled between the first raising plates 16, the horizontal portion 26 of the propelling member 24 in engagement with the front tilting dog 32 slides upward along the second sloping sides 16*c* of the raising plates 16 and is thereby disengaged from the front tilting dog 32 (see FIG. 9). The first carrier 29** thus relieved of the propelling force slightly advances by virtue of the inertia without producing any adverse effect on the carrier transfer operation. In fact, this is rather favorable, because while the carrier advances at a decelerated speed, the carrier will be pushed forward from behind as will be described later, with the result that the carrier advances substantially continuously.

The second carrier and the succeeding carriers following the first carrier are still in forward travel along with the drive chain 5. When the second carrier 29 comes to the position $C_1$ and is ready to pass between the second raising plates 17 at the entrance end of the transfer station L, the plates 17 are in their turned operative position like the first raising plates 16. Accordingly, the horizontal portion 26 of the propelling member 24 in engagement with the second carrier 29 ascends the second sloping sides 17*c* in the same manner as above, whereby the member 24 is disengaged from the front tilting dog 32. At this time, the stop pin 44 on the front trolley 30 of the second carrier 29 comes into contact with the projecting pieces 17*d* on the second raising plates 17, whereupon the second carrier 29 is halted. The disengaged member 24 slides over the upper sides 17*a* of the raising plates 17 or down the slanting edges 9*b* of the auxiliary rails 9 and further slides along on the top of the free rail 1 along with the chain 5.

Figure 10:
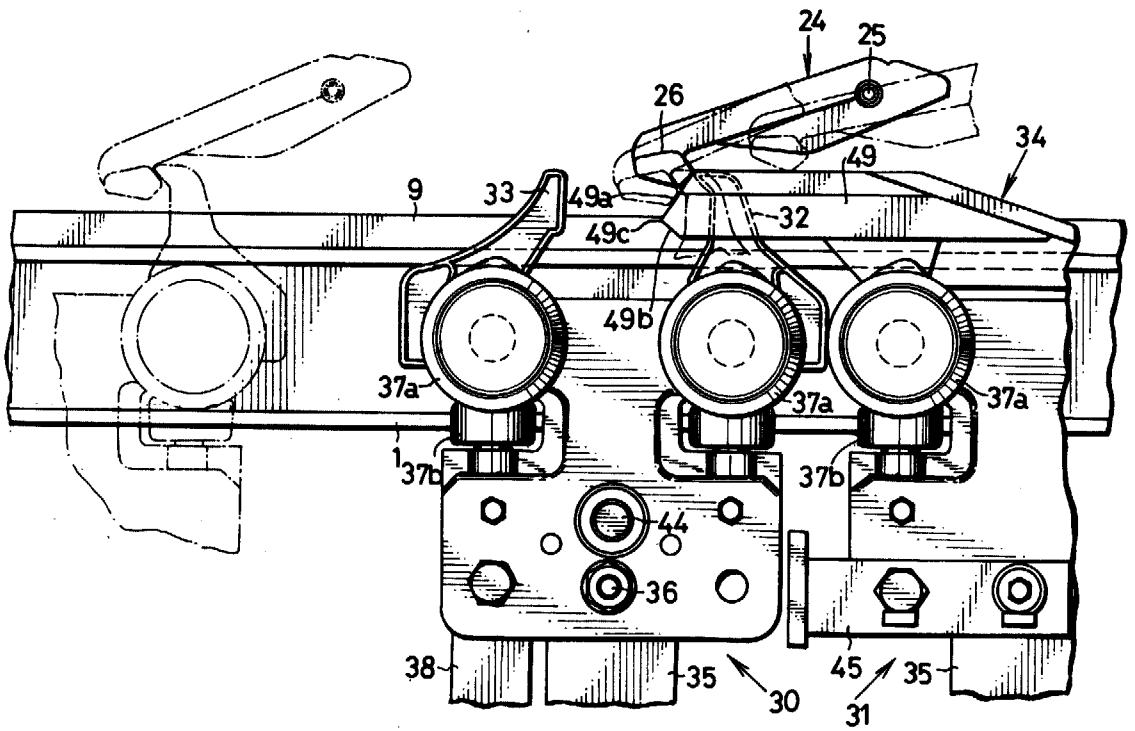
FIG. 10 is an enlarged side elevation showing carriers halted in succession.

The third carrier 29 continues to advance toward the second carrier 29 now in its halted position. Consequently, the front tilting dog 32 on the front free trolley 30 of the third carrier enters the cutout 48 of the cam 34 on the rear free trolley 31 of the second carrier. At this time, the propelling member 24 in engagement with the front tilting dog 32 is raised out of engagement with the dog 32 and passes over the preceding rear free trolley 31, because its horizontal portion 26 rides the sloping cam faces 49*a* of the opposite side projections 49 of the cam 34. As a result, the third carrier stops in contact with the second carrier (see FIG. 10). The disengaged member 24 continues to advance toward the second raising plates 17. The drive chain 5 carrying the members 24 continues to travel, while the fourth and following work carriers come to a halt each in contact with the preceding carrier.

From the description given above, it will be apparent that a number of carriers can be stopped one after another behind the second raising plates 17. The second raising plates 17 need only to disengage a propelling member 24 from a following carrier to cause the member 24 to push the preceding carrier from behind at the branching portion. Accordingly, if the propelling members 24 are arranged at an optimum spacing with the second raising plates 17 adapted to operate with suitable timing, the number of the carriers to be stopped behind the second raising plates 17 can be adjusted to two or three as will be apparent from the following description.

Figure 11:
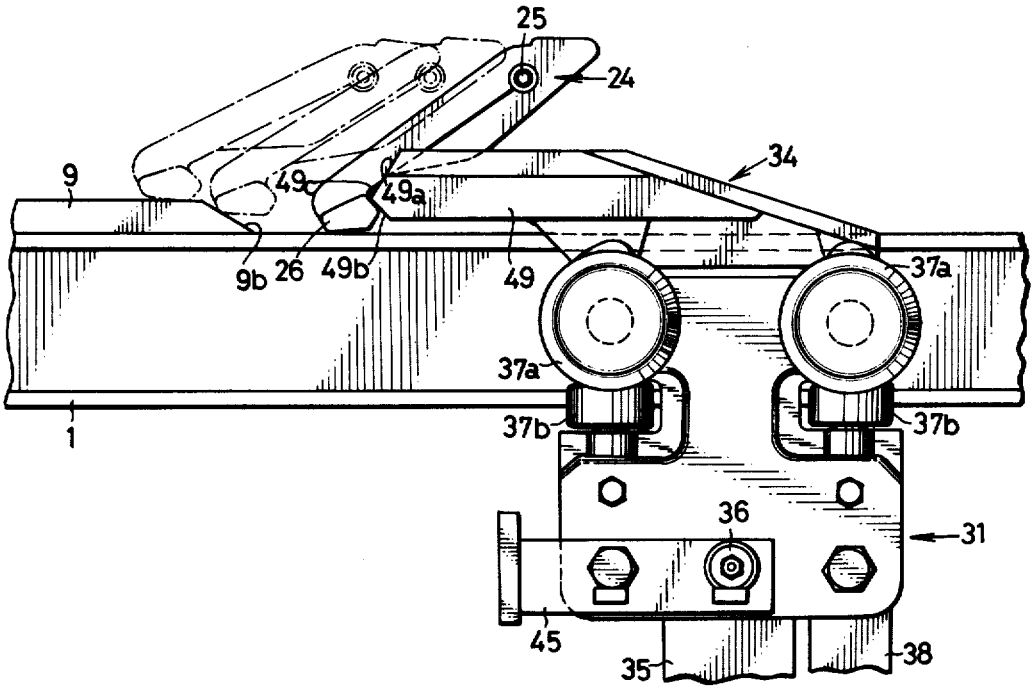
FIG. 11 is an enlarged side elevation showing a propelling member when it starts to push a carrier from behind.
Figure 12:
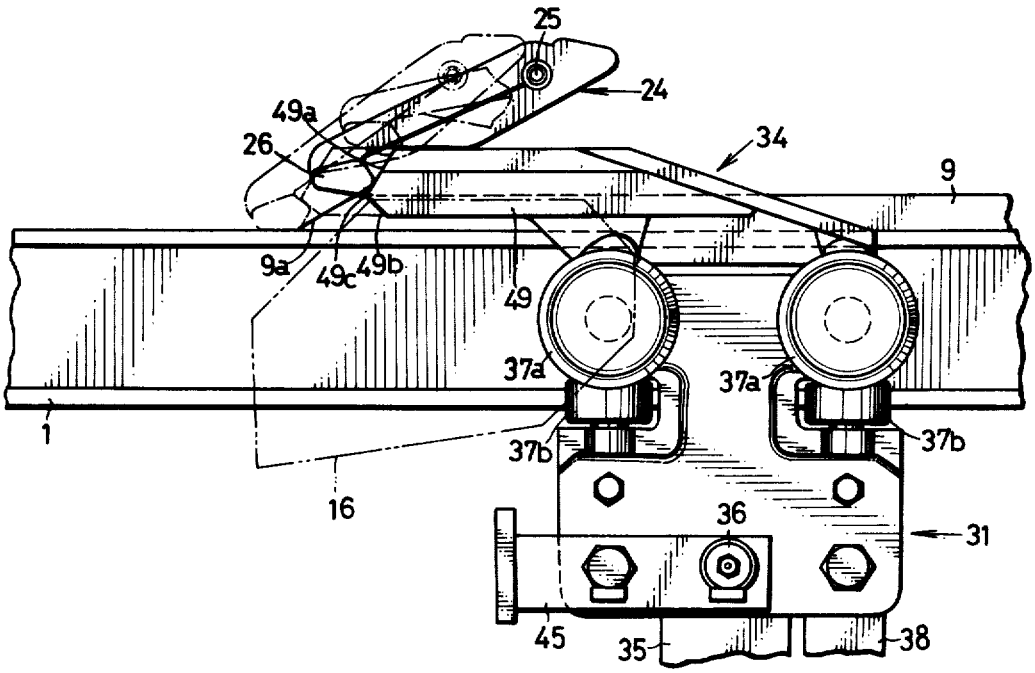
FIG. 12 is an enlarged side elevation showing the propelling member on completion of the pushing operation.

Advancing from behind the first carrier 29 released by the first raising plates 16 from the propelling member 24 on the drive chain 5 is the propelling member 24 disengaged by the second raising plates 17 from the dog on the second carrier. The latter member 24 catches up with the rear trolley 31 on the first carrier 29. Since the horizontal portion 26 of this member 24 is sliding on the top of the free rail 1, the horizontal portion 26 comes into engagement with the sloping faces 49*b* of the side projections 49 of the cam 34 on the rear trolley 31 and pushes the first carrier 29 from behind with the travel of the drive chain 5 (see FIG. 11). With the switching device 12 already shifted to the solid-line deviating position in FIG. 1, the front trolley 30 on the first carrier pushed by the propelling member 24 advances along the branch rail 3. Upon the rear trolley 31 reaching the front end of the section L, the horizontal portion 26 of the propelling member 24 slides upward along the slanting edge 9*a* of the auxiliary rail 9, whereby the member 24 is disengaged from the cam 34 (see FIG. 12). At this time the first raising plates 16 may be in their operative position with the first sloping sides 16*b* in horizontal position or may be in their non-operative position. The front trolley 30 on the first carrier 29 has already reached the second free rail 2 as indicated at $C_3$ in FIG. 1. A propelling member 28 suspended from the drive chain 7 travelling along the second power rail 2 forwardly tilts the rear tilting dog 33 on the front trolley 30 and comes into engagement with the front tilting dog 32. The propelling member 28 therefore drives the first carrier 29 along the second free rail 2. Before the engagement of the member 28 with the dog 32, the member 28 will not strike the side of the second free rail 2, since one of the auxiliary rails 10 secured to the rail 2 has the collision preventing projection 11 continuous therewith, permitting the member 28 to rise along the slanting edge 11*a* first and thereafter reach the top of the auxiliary rail 10. Further because the top of the projection 11 is at a level at least higher than the tilting dogs 32 and 33, the propelling member 28 will not engage the front tilting dog 32 while the member 28 is sliding over the top of the projection. The propelling member 28 on the top of the rails 10 engages the dog 32 when the front trolley 30 has reached the second free rail 2 upon completion of the pushing of the first carrier 29 by the propelling member 24. Thus the collision of the propelling member 28 with the dog 32 or 33 or improper engagement of the member 28 with the dog 32 can be avoided.

When the second raising plates 17 are returned to their original position, the propelling member 24 disengaged from the third carrier and advancing toward the front trolley 30 of the second carrier forwardly pushes down the rear tilting dog 33 on the front trolley 30 of the second carrier 29 and engages the front tilting dog 32. The second carrier 29 starts to advance with the drive chain 5. On the passage of the member 24, the rear tilting dog 33 is returned to its original position by gravity. With the advance of the second carrier 29, the rear trolley 31 thereof departs from the front free trolley 30 of the third carrier, with the result that the following propelling member 24 comes into engagement with the front tilting dog 32 on the front free trolley of the third carrier in the same manner as above, thus advancing the third carrier. In this way, the carriers held halted start one after another as spaced apart by the distance between the propelling members 24. Advantageously, the first and second raising plates 16 and 17 may be brought into and out of operation in operative relation to each other. For this purpose, the raising plates 16 and 17 are adapted to be actuated on the entrance of the front trolley 30 of the first carrier into the cutaway section L and to be returned to their original position immediately before the rear trolley 31 of the first carrier reaches the position of the first raising plates 16.

In the same manner as already described, the second carrier following the first carrier is pushed from behind in the cutaway section L and is transferred to the second free rail 2 by way of the branch rail 3.

When it is desired to transfer only the first carrier to the second free rail 2, allowing the second carrier to advance straight along the first free rail 1, the switching device 12 is shifted to the broken-line straight position in FIG. 1 after the first carrier has been transferred to the second free rail 2.

The raising plates 16 and 17 in the foregoing embodiment are made turnable to raise the horizontal portion 26 of the propelling member 24, whereas it is apparently possible to alternatively use a raising plate vertically movable and having a horizontal portion and a front and a rear sloping portion continuous therewith. Further when the conveyor is driven at a low speed, the carrier is stoppable merely by disengaging the propelling member 24 from the tilting dog 32. Thus, the stop pin 44 and projecting piece 17*d* can be dispensed with.

Although the term "raising cam 34" is used in the above description, the portion thereby referred to may be termed "pushing engagement means" when it is adapted to function mainly for pushing the carrier at the branching portion. Either one of the terms may be used selectively depending on which of the functions is principal.

This invention may be embodied differently without departing from the spirit and basic features of the invention. The scope of the invention is defined by the appended claims. Various alterations and modifications within the definition and scope of the claims are therefore included in the claims.

What is claimed is:

1. In a power-and-free conveyor including a first free rail serving as a main track, a second free rail branching off from the first free rail, a first and a second power rail provided above the free rails respectively at a specified distance therefrom, carriers movably supported by the first free rail, and a plurality of propelling members supported by the power rails as spaced apart by a specified distance and movable along the power rails, the carriers being travellable along the first free rail and transferable from the first free rail to the second free rail by being propelled by the propelling members, a transfer system comprising the carriers each having at its front portion main engaging means engageable with and disengageable from the propelling member and at its rear portion pushing engagement means, an auxiliary rail attached to at least the first of the free rails and slightly projecting above the first free rail to receive the bottom of the propelling members in sliding contact therewith, the auxiliary rail being attached to at least one side of the first free rail and having a cutaway section of required length to the rear of the branching point of the second free rail, a first disengaging means disposed near the front end of the cutaway section of the auxiliary rail for disengaging the propelling member from the main engaging means on a carrier advancing into the cutaway section, a second disengaging means disposed near the rear end of the cutaway section of the auxiliary rail for disengaging the propelling member from the main engaging means on a following carrier, the pushing engagement means being formed at its rear end with a pushing engagement sloping face forwardly downwardly sloping from substantially the same level as the upper edge of the auxiliary rail and engageable by a propelling member advancing from behind within the cutaway section, the end of the auxiliary rail defining the front end of the cutaway section being formed with an upwardly slanting edge for disengaging the propelling member from the pushing engagement means.

2. A transfer system as defined in claim 1 wherein the second free rail is provided with an auxiliary rail.

3. A transfer system as defined in claim 1 wherein the propelling members are pivotably attached to drive chains travelable below the power rails and are suspended from the chains as projected rearwardly obliquely downward by gravity, each of the propelling members having a hook-shaped lower end provided with a horizontal portion.

4. A transfer system as defined in claim 1 wherein the end of the auxiliary rail at the rear end of the cutaway section has a downwardly slanting edge.

5. A transfer system as defined in claim 1 wherein the disengaging means includes a polygonal raising plate having a horizontal upper side, a first sloping side continuous with the upper side at an obtuse angle thereto and a second sloping side continuous with the first sloping side at an obtuse angle, the raising plate being turnable through a specified angle.

6. A transfer system as defined in claim 1 wherein the second power rail has a circular arc turn in the vicinity of the branching point, and an auxiliary rail is attached to the second free rail and extends away from the second free rail along the circular arc of the second power rail to provide a collision preventing projection having an upwardly slanting edge at one end of the projection.

7. A transfer system as defined in claim 1 wherein the carrier comprises a front free trolley having the main engaging means and a rear free trolley having the pushing engagement means, the front and rear free trolleys being connected together by a link.

8. A transfer system as defined in claim 1 wherein the main engaging means comprises a pair of front and rear tilting dogs.

9. A transfer system as defined in claim 1 wherein the pushing engagement means is formed centrally in its rear portion with a U-shaped cutout defined by rear projections on its opposite sides, the extremity of each of the rear projections having a ridge substantially at the same level as the upper edge of the auxiliary rail, the ridge being defined by a sloping cam face for raising the propelling member and the pushing engagement sloping face sloping in a direction different that said cam face.

10. In a power-and-free conveyor system of the type having a free rail, a work carrier on said free rail having a front driving dog and a rear cam member, a power rail spaced from said free rail, propelling means on and movable along said power rail having a pusher and means mounting said pusher for movement between a position in which it drivingly engages said driving dog to move said carrier along said free rail and a position in which it is disengaged from said driving dog, and a transfer station through which said carrier travels in moving from one section of said free rail to another section thereof, the improvement comprising means coacting with said pusher normally constraining the same for movement between normal-engaged and disengaged positions, said cam member having a cam portion and a driving portion, said cam portion being engageable by said pusher in its normal-engaged position and operable to deflect the latter to said disengaged position to override said cam member, said driving portion being engageable by said pusher by movement of the latter beyond its normal-engaged position, means permitting said pusher to move beyond its normal-engaged position in said transfer station for engagement with the driving portion of said cam member during travel of said carrier through said transfer station, and means for disengaging said pusher automatically from said driving dog and said cam member as said dog and said cam member moves out of said transfer station.

11. A power-and-free conveyor system comprising a free rail, a work carrier on said free rail having a front dog driving member and a rear cam member, said cam member having a cam portion disposed relatively far from said free rail and a driving portion disposed relatively close to said free rail, propelling means on and movable along said power rail having lead and following pushers each mounted for movement toward and from said free rail between a position in which it is completely disengaged from said carrier and first and second engaged positions, said pusher being engageable with the cam portion only of said cam member in the first engaged position and with the driving portion of said cam member in the second engaged position, both of said pushers being engageable with the driving dog member of said carrier in both first and second engaged positions, a transfer station through which said pushers and said carrier travel during movement of the carrier from one section of said free rail to another section thereof, and means coactive with said pushers permitting movement thereof between said disengaged and said second engaged positions during movement thereof through said transfer station only but normally restricting said pushers to movement between said disengaged and said first engaged positions.

12. In a power-and-free conveyor system of the type having spaced power and free rails, and a transfer station, the improvement comprising propelling means on and movable along said power rail having a plurality of spaced pushers each movable from a retracted inoperative position selectively to either a normal engaged position or an extended engaged position, work carriers movable on said free rail and through said transfer station, each of said carriers having a front driving dog and a rear cam member, said driving dog being engageable by said pushers in both engaged positions of said pushers to drive said carrier from the front, said cam member having a cam portion and a driving portion, said cam portion being engageable by said pushers in the normal extended position only and operative to cause the pushers to override said cam member, said driving portion being engageable by said pushers in said extended engaged position only to drive said carrier from the rear, means permitting movement of said pushers to said normal engaged position and normally preventing movement thereof to said extended engaged position but permitting movement of said pushers to said extended engaged position during movement thereof through said transfer station, and means for disengaging said pushers from said carriers automatically at the exit end of said transfer station.

13. The power-and-free conveyor system defined in claim 12 having means for disengaging said pushers from selected carriers automatically at the entrance end of said transfer station.

* * * * *